US006877688B2

(12) United States Patent
Jordan et al.

(10) Patent No.: US 6,877,688 B2
(45) Date of Patent: Apr. 12, 2005

(54) PREPARING STRAND CABLE FOR CONCRETE MOLD

(75) Inventors: A. Kenneth Jordan, Arlington, TX (US); Timothy D. Pearce, Aledo, TX (US); Gregory L. Hodge, Crowley, TX (US)

(73) Assignee: Hamilton Form Co., Inc., Ft. Worth, TX (US)

( * ) Notice: Subject to any disclaimer, the term of this patent is extended or adjusted under 35 U.S.C. 154(b) by 354 days.

(21) Appl. No.: 09/953,474

(22) Filed: Sep. 12, 2001

(65) Prior Publication Data

US 2003/0047826 A1 Mar. 13, 2003

(51) Int. Cl.[7] ..... B65H 67/048; B65H 67/06; B65H 54/04; B28B 23/06; B28B 23/18

(52) U.S. Cl. ..... 242/473.5; 242/470; 242/487.5; 242/128; 242/156; 254/29 A; 254/134.3 R; 264/40.1; 264/138; 264/228; 264/229; 425/111; 29/452

(58) Field of Search ..... 264/228, 229, 264/40.1, 138; 425/111; 29/452; 242/128, 470, 487.5, 473.5, 156; 254/29 A, 134.3 R

(56) References Cited

U.S. PATENT DOCUMENTS

| | | | | | |
|---|---|---|---|---|---|
| 2,863,206 | A | * | 12/1958 | Kirchner | 425/111 |
| 3,792,821 | A | | 2/1974 | Fallon | 242/42 |
| 3,823,590 | A | * | 7/1974 | Lang | 72/66 |
| 3,827,132 | A | * | 8/1974 | Bratchell | 29/433 |
| 3,892,826 | A | * | 7/1975 | Yost | 264/72 |
| 3,897,914 | A | | 8/1975 | McCarthy et al. | 242/129.6 |
| 3,975,815 | A | * | 8/1976 | Mori | 29/433 |
| 4,290,991 | A | * | 9/1981 | Thim | 264/157 |
| 4,534,310 | A | | 8/1985 | Quick | 118/620 |
| 4,659,033 | A | * | 4/1987 | Bush et al. | 242/438.1 |
| 4,884,958 | A | | 12/1989 | Lowndes, III et al. | 425/62 |
| 5,031,847 | A | | 7/1991 | Tanaka | 242/54 R |
| 5,509,759 | A | | 4/1996 | Keesling | 405/232 |
| 5,595,355 | A | | 1/1997 | Haines | 242/470 |
| 5,603,469 | A | * | 2/1997 | Stocchi | 242/580 |
| 6,612,516 | B1 | * | 9/2003 | Haines | 242/397.1 |
| 2003/0098524 | A1 | * | 5/2003 | Jordan et al. | 264/228 |
| 2003/0151164 | A1 | * | 8/2003 | Jordan et al. | 264/228 |

FOREIGN PATENT DOCUMENTS

EP 0 441 029 A1 8/1991

* cited by examiner

*Primary Examiner*—Michael P. Colaianni
*Assistant Examiner*—Michael I. Poe
(74) *Attorney, Agent, or Firm*—Thompson & Gustavson, L.L.P.

(57) ABSTRACT

A method and apparatus is disclosed to prepare strand segments of predetermined length for use in a molded concrete product at an assembly facility. The strand segments are loaded into a strand reel (10) having multiple slots. The strand reel is then transported to the mold site. At the mold site, the strand segments can be simultaneously pulled out from the strand reel for placement in the mold.

17 Claims, 4 Drawing Sheets

PREPARING STRAND CABLE FOR CONCRETE MOLD

BACKGROUND OF THE INVENTION

Large concrete products are typically cast in molds. The process of casting is used to make large concrete products such as beams for use in highway bridges, tunnel liners, building construction and the like. Many of these concrete products have tensioned steel strands therein to prestress the concrete product. The steel strands are placed in the mold and tensioned before the concrete is poured in the mold. As the concrete cures, the steel strand and concrete bond and the tension in the strand creates the prestress in the concrete product. Each of the strands is typically tensioned by 30,000 pounds force. Often, the strands are also tensioned perpendicular their length into a slight V shape near the middle of the mold to provide negative loading at the top of the concrete product.

In a self stressing mold, bearing plates(sometimes referred to as jacking plates) are placed at the ends of the mold and the ends of the strands in the mold pass through aligned holes in the plates and extend outwardly from the plates a length sufficient to allow a hydraulic cylinder or other tensioning device to grasp an end of the strand to tension the strand. Once tensioned, conical wedge type strand chucks acting between the strand and the plates maintain the tension. Because the tension in the strands is passed through the plates, and the plates engage the mold, the tension, in turn, passes through the mold. In such a design, the mold must be sufficiently strong to absorb these stresses.

In other applications, external abutments may be provided at each end of the mold to tension the strands passing through the mold. The external abutments are supported in the ground at the mold site or supported by other structures. In this design, no bearing plates are necessary. The mold is not exposed to the tension forces in the strands and consequently need not be designed to withstand those stresses.

A typical concrete product is a T or double T molded in a long T or double T-shaped mold which may use 6 tensioning strands in each leg of the T(for a total of 12 in a double T), for example. The mold is often sufficiently long to mold a number of concrete products simultaneously therein along the length of the mold. For example, a mold may be over 400 feet long, and used to mold up to ten 40 foot long T or double T concrete products simultaneously. The ends of the concrete products are formed by headers or bulkheads inserted into the mold at the desired spacing to confine the liquid concrete as it is poured into the mold. The concrete products are commonly reinforced by rebar or mesh. Commonly, such T or double T molds are self stressing and the concrete products are prestressed by tensioned steel strand passing through bearing plates at the ends of the mold, the headers and the concrete product from end to end, which bonds to the concrete as the concrete cures. The bearing plates hold and distribute the tensioning forces in the steel strand. The bearing plates are typically steel about 4 inches thick to resist the tensioning forces exerted.

Molds for a large, 120 foot long highway I beam, using perhaps 60 separate steel strands, each ⅜, ½, or 9/16 inch in diameter, for example, are not self stressing. The strands are drawn through the mold(passing through aligned holes in any headers used) and tensioned between external abutments.

As each strand will usually be at least as long as the mold, say 400 to 500 feet, with some extra length to extend out the ends of the bearing plates or to the external abutments, the difficulty of manipulating such strand lengths can be appreciated. In the past, if 60 strands were needed in the concrete product, 60 separate strand packs could be positioned at the mold site. Similarly, a double T may use 12 separate strands, 6 for each of the two legs of the double T, requiring 12 separate strand packs to be positioned at the mold site. The strands are pulled through the mold simultaneously. Once the strands are in place, the strands are cut off the strand packs adjacent the bearing plate or external abutment and tensioned. Each strand pack typically has about 12,000 feet of strand(the actual length dependent on the diameter of the strand). For ten 40 foot T concrete products molded simultaneously in a mold somewhat over 400 feet long, only a little more than 400 feet of strand off of each of the strand packs would be needed for the concrete products. Thus, expensive inventory, represented by the unused strand on the strand packs, is idle as the concrete products cure.

SUMMARY OF THE INVENTION

In accordance with one aspect of the present invention, a method is provided for casting a large concrete product formed in a mold at a mold location and having a plurality of strands to prestress the concrete product. The method includes the steps of placing a strand pack of strand on a reel which is part of a strand pack payout device with a retarding brake at an assembly location. The strand pack is a rolled up, tightly wound coil of strand held together with steel banding at multiple locations. The method also includes the step of placing a strand reel on a strand reel winder, the strand reel having a plurality of slots or compartments for receiving a length of strand. The slots are of sufficient capacity to receive a predetermined length of strand slightly longer than the form or mold. The strand reel is rotated on the strand reel winder about an axis of the strand reel. A first segment of the strand having a predetermined length is pulled out from the strand pack on the strand pack payout device under tension. The first segment is wound under tension on the strand reel into a first one of said plurality of slots on the strand reel. A second segment of the strand also having the same predetermined length is pulled out from the strand pack on the strand pack payout device under tension, The second segment is wound under tension onto the strand reel into a second one of said plurality of slots. Additional segments can fill the remaining slots. The strand reel is then removed from the strand reel winder and transferred to the mold location.

In accordance with other aspects of the present invention, the strand is pulled out from the strand pack by a tensioning unit having pulling wheels. A retarding brake in the strand pack payout device resists the pulling effort by the pulling wheels which places the strand under tension. The predetermined length of the first and second segments can be measured by a counter unit. The method further includes the step of securing the free end of the first and second segments in the first and second slots, respectively, of the strand reel. The method further includes the step of cutting the first and second segments of strand into the predetermined length. The method further includes attaching at least one strand holding device in the rim of the strand reel at each slot to hold the segment within the slot of the strand reel. The method further includes the step of successively paying out subsequent segments of strand, each subsequent segment of said predetermined length, from the strand pack under tension and winding said subsequent segment into a subsequent one of said plurality of slots in the strand reel until each slot in the strand reel has a segment of strand of predetermined length therein.

BRIEF DESCRIPTION OF THE DRAWINGS

A more complete understanding of the invention and its advantages will be apparent from the following Detailed Description, taken in conjunction with the accompanying drawings, in which.

DETAILED DESCRIPTION OF THE INVENTION

Figure 1:
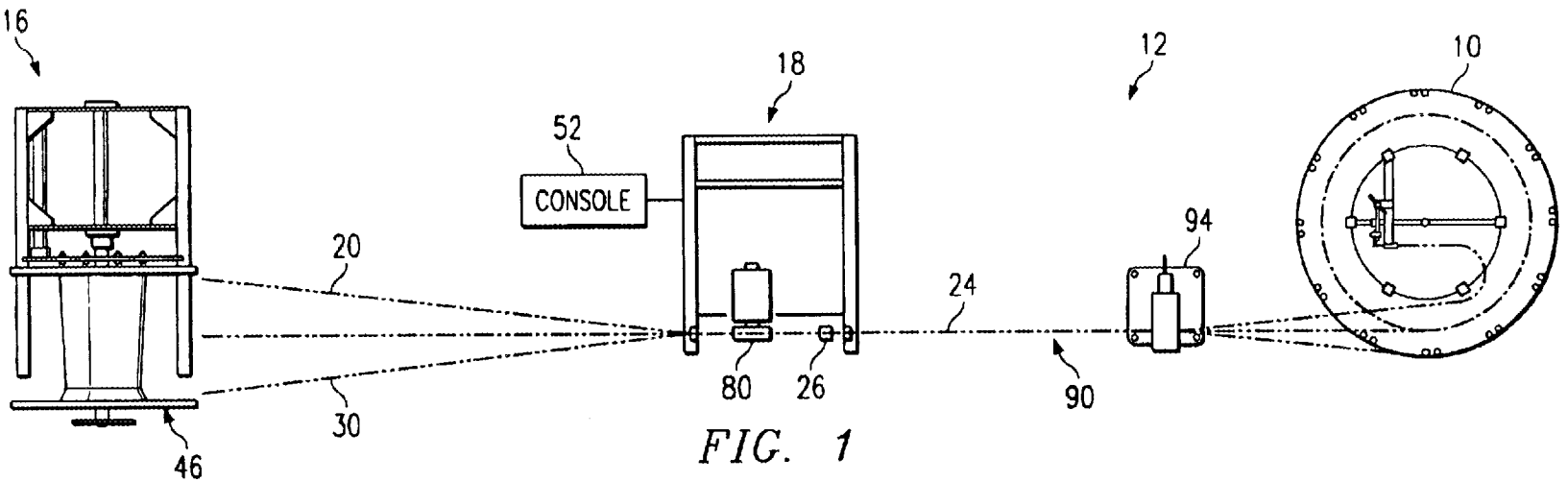
FIG. 1 is a plan view of the assembly location of the present invention.
Figure 2:
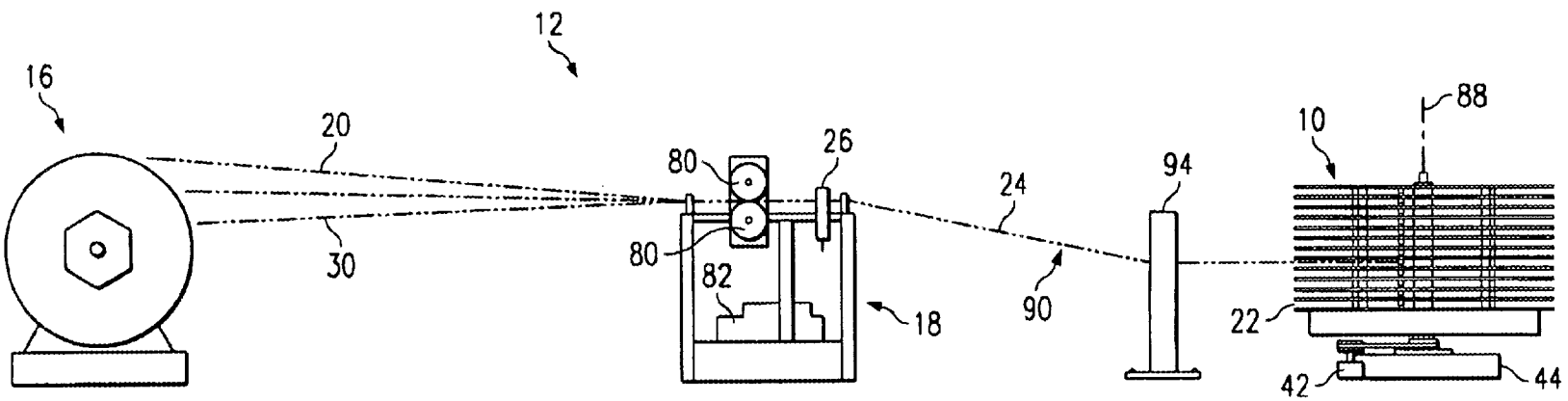
FIG. 2 is a side view of the assembly location.

In accordance with the present invention, a process is contemplated which increases efficiency. Rather than measuring and cutting the strand 30 on the site of the mold, the invention contemplates premeasuring and precutting strand 30 in an assembly facility 12 remote from the mold site 14 and filling one or more multiple strand reels 10(FIG. 1) with, for example, eight or twelve of the premeasured, precut strand segments in a like number of individual slots in the reel. The strand reels 10 are then transported to the mold site. At the mold site, the free ends of the strand lengths stored on a strand reel 10 can be pulled out simultaneously for feeding through the mold.

Figure 10:
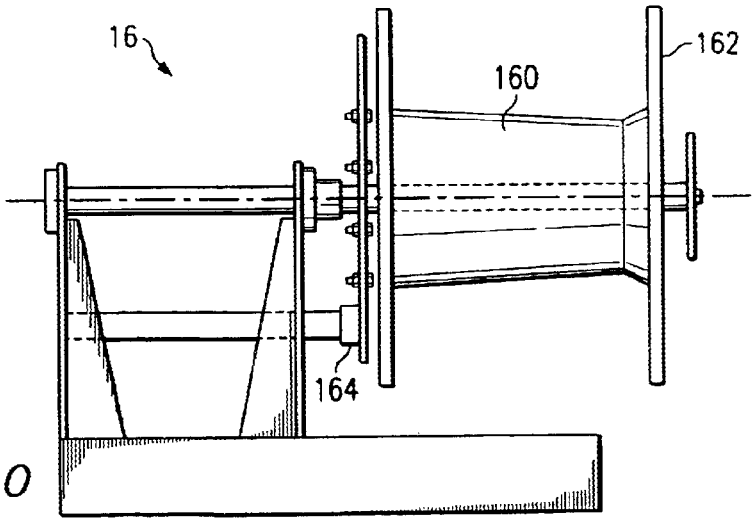
FIG. 10 is a side view of the strand pack payout device.

Now, describing the invention in more detail, with reference to FIGS. 1 and 10, a strand pack 46 from a supplier, usually containing 12,000 feet of strand 30, is mounted on a rotatable reel 160 in a strand pack payout device 16 at the assembly facility and secured on the reel 160 by a drum retainer 162, which allows the strand 30 to be pulled out into a counter unit 18. The strand pack is tightly wound by the manufacturer and held together with steel banding in multiple locations. Preferably, a length of the outer end of the strand 30 slightly longer than the distance from the strand pack payout device 16 to the counter unit 18 is left outside the steel banding. This length is wrapped around the strand pack 46 and held by only a single band. When the strand pack 46 is mounted on the strand pack payout device, this single band is cut and the outer end of the strand 30 is fed into pulling wheels 80 in the counter unit 18. Strand pack payout device 16 has a retarding brake 164 on the reel 160 which resists rotation of the reel 160 and therefore resists effort to pull strand off the strand pack in the strand pack payout device, thus inducing tension in the strand as it is pulled off to control the payout of the strand 30. The pulling wheels 80 in counter unit 18 are rotated by a power unit such as a hydraulic motor 82 to pull strand 30, which, due to the resistance of the retarding brake, establishes and maintains a predetermined pulling tension in the length 20 of the strand 30 between the payout device 16 and counter unit 18 sufficient to allow the remaining bands on the strand pack 46 to be cut safely. This tension, for example, can be about 5,000 pounds force. The counter unit 18 measures the length of strand 30 passing through the pulling wheels 80.

Figures 3, 4:
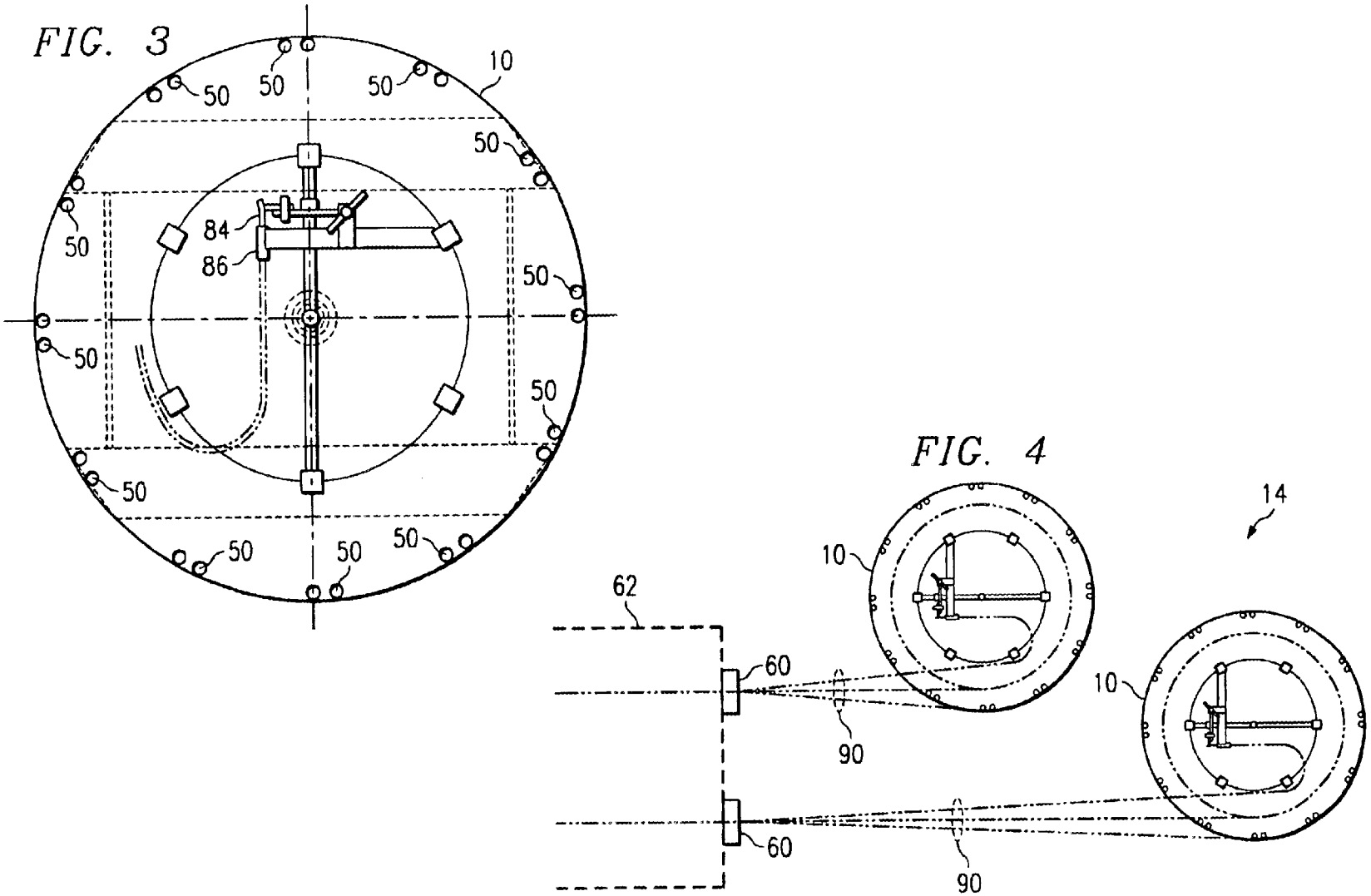
FIG. 3 is a plan view of the strand reel.
FIG. 4 is a plan view of a portion of the mold location illustrating strand reels positioned to place the strand in the mold.
Figure 7:
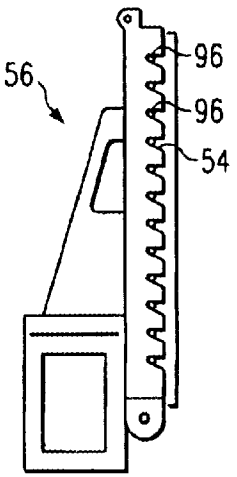
FIG. 7 is a front view of the strand feeder device.

The strand 30 is then feed into one of the twelve slots 22 on the strand reel 10, with the free end 84 of the strand 30 secured to the inside of the slot, preferably by a conical wedge type strand chuck 86, as seen in FIG. 3. The strand reel 10 is supported on a strand reel winder 44 and is rotated about its vertical axis 88 by a hydraulic motor 42 in strand reel winder 44 to wind the strand 30 into a slot 22. The hydraulic motor 42 maintains tension in the length 24 of the strand 30 between the counter unit 18 and strand reel 10. The tension exerted by hydraulic motor 42 in the length 24 is less than the tension exerted in the length 20 so that the pulling wheels control the speed of strand 30. Hydraulic motor 42 exerts sufficient tension to prevent hockle in the strand 30 as it is wound in the slots. An adjustable height fairlead 94 is preferably positioned between the counter unit 18 and the strand reel 10 to help guide the strand 30. When a desired length of the strand 30 has been pulled off the strand pack 46 as measured by the counter unit 18, a spring clip or other suitable device is fit into holes 50 formed in the reel 10 to hold the portion of the strand already in the slot. A strand cutter 26 on the counter unit 18 then cuts the strand 30 to form a strand segment 90 of predetermined length. The strand reel 10 continues to rotate to take up the loose end of the strand segment 90 into the slot. The loose end of the strand segment 90 is also then held in the slot by spring clips or other suitable devices fit into holes 50. This operation is repeated until all twelve slots in the reel 10 are each filled with a strand segment 90 of the predetermined length. Any number of slots can be provided in the reel 10, such as 8, 12, 15, etc. The strand reel 10 can be sized as needed for the strand segments to be used. In one strand reel constructed in accordance with the teachings of the present invention, the diameter of the strand reel is 5 feet, with each of the 12 slots being 2 inches high and about 1 foot deep. Each slot can hold a strand segment 90 of length up to about 500 feet.

Additional strand reels 10 are filled as needed for the particular concrete product to be molded. The reels 10 can be lifted off the hydraulic strand reel winder 44 by a fork lift or crane when filled and a new, empty reel placed on the hydraulic strand reel winder 44 to receive additional strands segments 90. When sufficient reels have been filled, they are transported to the mold site 14. The operation can be controlled through a manually operated console 52 on the counter unit 18 or remotely, through a small hand held radio transmitter if desired, to avoid exposing personnel to the strand 30 as it is payed out.

It will be appreciated that it is important to maintain the strand 30 in tension at all times as the strand is pulled off the strand pack 46 and formed into strand segments 90 in the slots 22 of the strand reel. If the strand 30 is not maintained in tension, it can hockle, kink or otherwise compromise its linearity. Typically, the strand 30 is made up of a number of smaller diameter strands twisted together, for example, 7 smaller diameter strands may be twisted together to form a single strand 30(usually one center strand and 6 outer strands). Another advantage is that the strand 30 pulled out from the strand pack 46 is taken from the outer diameter of the pack 46, while the strand 30 taken out from a pack at the mold site is typically taken from the inner diameter of the pack, and thus more likely to require the strand 30 be rotated as it is removed from the pack to prevent hockle. The strand 30 is also very unlikely to be nicked or cut in the controlled operation at the assembly facility, a risk which is high when it is taken from a strand pack at the mold site. A nick or cut could severely compromise the strength of the strand in use. Also, the strand is less likely to be dragged across contaminating surfaces such as the ground or other surfaces so that oil, grease, dirt etc. is substantially less likely to contaminate the strand, resulting in a better concrete to steel bond and thus a stronger and safer product.

A typical strand 30 that would be used in the present invention is the ½ inch diameter 270K Oversize (13-1860)

Low Relaxation Prestressing Strand such as provided by ASW. Such a strand has a minimum Breaking Weight of 45,000 lbs, a minimum 1% Yield Strength of 40,500 lbs and a minimum Elongation of 3.5%. The strand has a nominal diameter of 0.526 inches, a nominal area of 0.167 square inches and a typical Modulus of $28\times10^6$ psi. The average O.D. of the supply roll for a supply roll of 12,000 feet of strand of this type is 48.5 inches while the average I.D. is 29.5 inches. The strand roll weighs an average of 6,240 lbs and costs about $15,000.00.

Strand can vary in properties from one strand pack to another. One advantage of the present invention is that by forming a series of strand segments 90 from a single strand pack, the properties of the strand segments in the concrete product will be more uniform and it will be substantially easier to keep records of the particular batch or strand pack of strand used in the concrete product should an issue ever arise as to the quality of the strand used, since the product will generally have strand from only one strand pack.

Once the strand reels 10 have been transported to the mold site with the strand segments 90 stored in the slots therein, they are placed on stands 48 which also permit them to rotate about their vertical axis to pay out the premeasured strand segments for use in the mold 62. While mold 62 will be described as a self stressing mold, using bearing plates 60, the advantages of the present invention would be equally useful in a mold using external abutments to tension the strands.

In one procedure, the exposed ends 96 of each of the strand segments in the strand reel are freed and pulled off the strand reel to free a sufficient length of the strand segments to place the ends 96 directly through the bearing plate 60 at the end of the mold 62. The strands are then pulled simultaneously through the mold 62, with the strand reel 10 rotating about its vertical axis to payout the strands.

Figure 5:
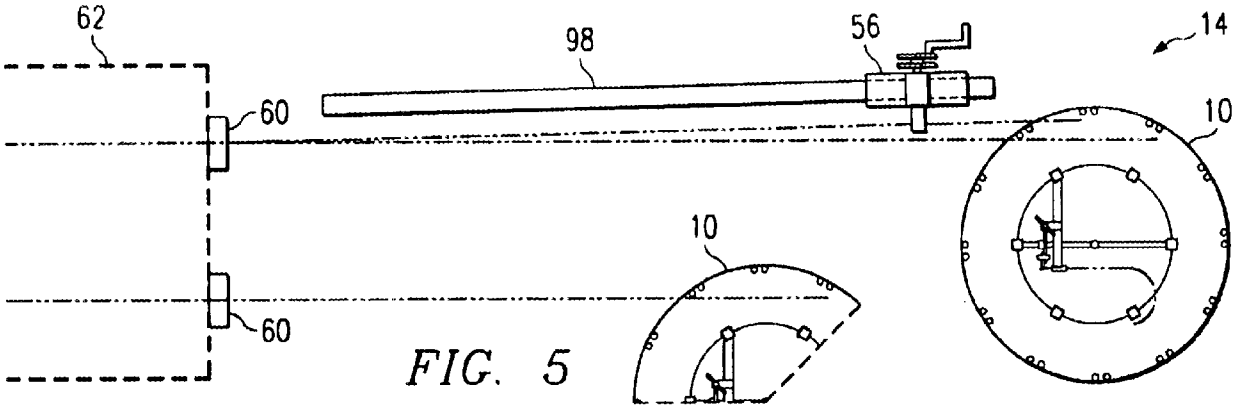
FIG. 5 is a partial plan view of the portion of the mold location illustrating the relationship between a strand reel and strand feeder device.
Figure 6:
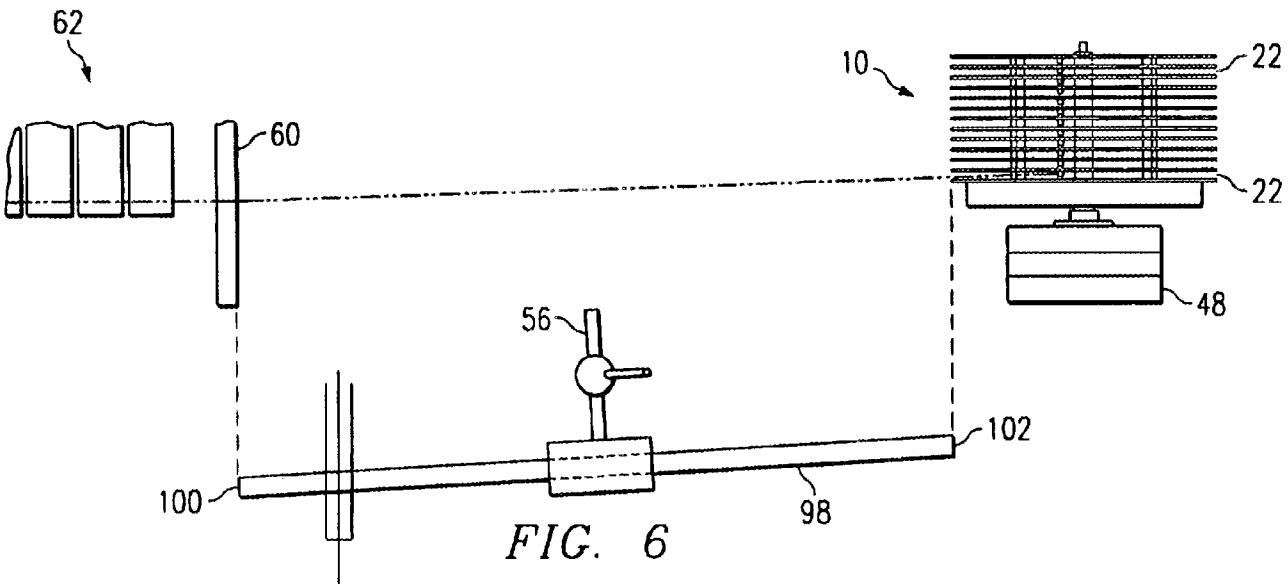
FIG. 6 is a side view of the portion of the mold location illustrating the relationship between the strand reel, feeder ramp and mold.
Figure 8:
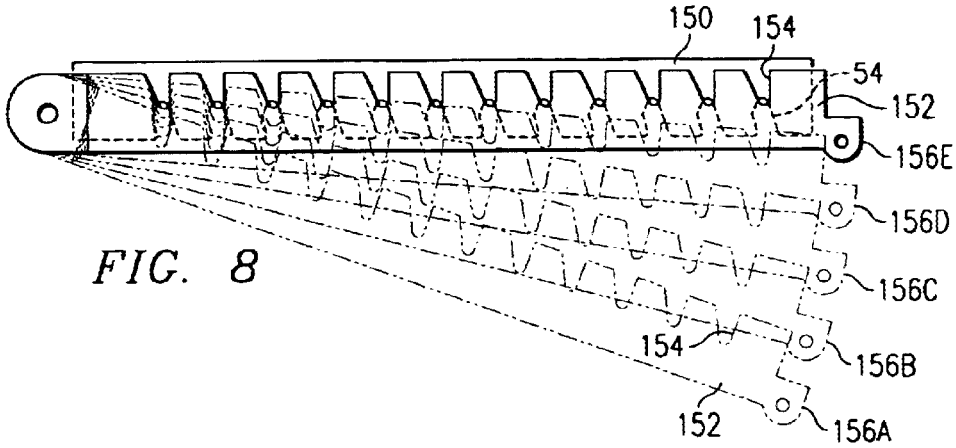
FIG. 8 is an illustrative view of a portion of the strand feeder device.
Figure 9:
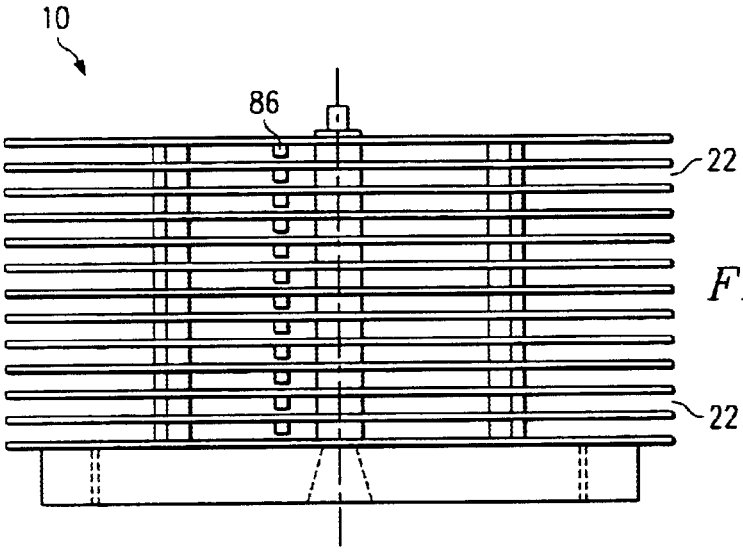
FIG. 9 is a side view of the strand reel.

However, in another procedure, to assist in the operation, a strand feeder device 56 is mounted for sliding motion on a track 98 for movement from a position adjacent the strand reel 10 to a position adjacent the bearing plate 60, as seen in FIGS. 5 and 6. The strand feeder device 56 has a stationary arm 150 having a series of slots 54 spaced vertically thereon, each slot 54 designed to receive the end of one of the strands. The ends 96 of each of the strand segments in the strand reel 10 are unclipped and freed from the strand reel 10 and then unwound from the strand reel 10 while the reel is stationary, one strand at a time. As the ends 96 are unwound, the ends 96 are placed in the slots 54 while the strand feeder device 56 is in the position adjacent the strand reel 10. A pivoting arm 152 with slots 154 is pivoted to the stationary arm 150 at one end thereof. As the strand ends 96 are inserted in the slots 54, the arm 152 is pivoted out of the way. Once the strand ends 96 are in the slots 54, the arm 152 is pivoted through positions 156A–E to capture the strand ends 96 in a wedging action between slots 54 and 154. The pivoting arm 152 is held in the wedging position 156E with a locking mechanism.

The strand feeder device 56 is mounted for sliding motion on the track 98, which is tilted downwardly toward the bearing plate 60. Once the ends 96 of the strand segments are secured to strand feeder device 56, the strand feeder device 56 is pulled down the track 98 with the ends 96 of the strand segments in the slots until the device 56 is proximate the bearing plate 60, causing the strand reel 10 to rotate on the stand 48 and pay out additional lengths of the strand segments.

In accordance with one device constructed in accordance with the teachings of the present invention, the track 98 was 17 feet long and was positioned with end 100 about 4 inches from the bearing plate 60 and the end 102 close to strand reel 10. The track 98 is formed from a 4 inch by 6 inch tube rectangular tube. The strand feeder device has 12 slots 54 spaced 2 inches apart vertically. The track sloped from a height of about 1 foot 11 inches at the end 102 to about 8 inches at end 100.

The invention has numerous advantages. Strands can be premeasured and cut sequentially from a single strand pack, until the strand pack is used up, making it easier to record the physical characteristics of the steel in the strand packs used in each concrete product, in the event questions arise as to the particular strand pack used in a given product. The strands can be sized and cut at a central facility, allowing a specialist to perform the operation in a cleaner and more sheltered environment. The many strand packs of strand no longer need to be placed and stored at the mold site. The personnel molding the member no longer need to be concerned with the sizing and cutting of the strands and do not need to be concerned with the recording of documentation concerning the strand in the mold, and can concentrate on the molding process, saving time at the mold.

Further, as the process requires only enough strand packs to supply all the needed strand segments, as opposed to at least one strand pack for each strand used in the mold at the mold site, as required before, it is anticipated that far less inventory of expensive strand will be necessary and at least 30% less area will be needed to store the strand packs for each mold. Also, it will be easier to store the expensive strand packs in a manner protected from the weather to avoid damage to the strands.

The supply reels 10 can be made up with the strand segments at any desired time before the pouring of the concrete product, such as the day or night before the pour, increasing the efficiency of the operation. The crew pouring the concrete product no longer need be concerned with the preparation of the strand segments, and need only place the premeasured strand segments in the mold as needed.

While a single embodiment of the present invention has been illustrated in the accompanying drawings and described in the foregoing Detailed Description, it will be understood that the invention is not limited to the embodiment disclosed, but is capable of numerous rearrangements, modifications and substitutions of parts and elements without departing from the scope and spirit of the invention.

What is claimed is:

1. A method of preparing a mold for casting a large concrete product formed in the mold at a mold location, the concrete product having a plurality of strands to prestress the concrete product, comprising the steps of:

placing a single strand pack of strand on a strand pack payout device at an assembly location;

placing a strand reel on a strand reel winder, the strand reel having a plurality of slots, each slot for receiving a length of strand;

rotating the strand reel on the strand reel winder about an axis of the strand reel;

pulling out a first segment of the strand of predetermined length from the single strand pack under tension and winding said first segment of strand of predetermined length into a first one of said plurality of slots in the strand reel under tension;

pulling out at least a second segment of the strand of said predetermined length from the single strand pack under tension and winding said second segment of said predetermined length into a second one of said plurality of slots in said strand reel under tension; and removing the strand reel from the strand reel winder and transferring the strand reel to the mold location to eliminate the need for strand packs at the location to supply strand to the mold.

2. The method of claim 1 further comprising the step of placing the free ends of the first and second segments of strand into a strand feeder device and subsequently pulling the strand feeder device along a track from proximate the strand reel to proximate the mold to pull the first and second segments of strand simultaneously from the strand reel.

3. The method of claim 1 further comprising the step of tensioning said first segment as it is pulled off the strand pack between a retarding brake on the strand pack payout device and a tensioning unit having pulling wheels.

4. The method of claim 1 further comprising the step of measuring the length of the first segment as it is pulled off the strand pack with a counter unit.

5. The method of claim 1 further comprising the step of securing the free end of the first segment to the strand reel within the first one of said plurality of slots.

6. The method of claim 1 further comprising the step of cutting the first segment of strand to form the first segment of said predetermined length.

7. The method of claim 1 further comprising the step of securing said first segment of strand in said first one of said plurality of slots.

8. The method of claim 1 further comprising mounting said strand reel on a stand proximate the mold at the mold location and pulling out said first segment of strand from said strand reel into the mold.

9. The method of claim 8 further comprising the step of placing the free end of the first segment of strand into a strand feeder device and subsequently sliding the strand feeder device along a track from proximate the strand reel to proximate the mold to pay out the first segment of strand from the strand reel.

10. The method of claim 9 further comprising the step of placing the free end of the first segment of strand into a notch in said strand feeder device.

11. The method of claim 1 further comprising the step of successively pulling out successive segments of strand of said predetermined length from the single strand pack under tension and winding said successive segments of said predetermined length of strand into successive ones of said plurality of slots in said strand reel under tension until all of said slots are filled to provide uniform properties to the plurality of strands in the mold.

12. The method of claim 11 further comprising mounting said strand reel on a stand proximate the mold at the mold location and pulling out said segments of strand from said strand reel into the mold.

13. The method of claim 12 further comprising the step of placing the free ends of the segments of strand into a strand feeder device and subsequently sliding the strand feeder device along a track from proximate the strand reel to proximate the mold to pay out all segments of strand from the strand reel.

14. The method of claim 13 further comprising the step of placing the free ends of all the segments of strand into notches in said strand feeder device.

15. A method of preparing a mold for casting a large concrete product formed in the mold at a mold location, the concrete product having a plurality of strands to prestress the concrete product, comprising the steps of:

placing a single strand pack of strand on a strand pack payout device at an assembly location;

placing a strand reel on a strand reel winder, the strand reel having a plurality of slots, each slot for receiving a length of strand;

rotating the strand reel on the strand reel winder about an axis of the strand reel;

pulling out a first segment of the strand of predetermined length from the single strand pack under tension and winding said first segment of strand of predetermined length into a first one of said plurality of slots in the strand reel under tension;

pulling out subsequent segments of the strand of predetermined length from the single strand pack under tension and winding said subsequent segments of strand of predetermined length into the remaining ones of said plurality of slots in the strand reel under tension;

removing the strand reel from the strand reel winder and transferring the strand reel to the mold location, each strand in said slots being used to form one of the plurality of strands to prestress the concrete product insuring uniform properties in the strands having come from said single strand pack and to eliminate the need for a strand pack at the mold location for each strand of said plurality of strands at the mold.

16. The method of 15 further comprising the step of replacing the single strand pack with a fresh single strand pack when no more strands of predetermined length remain on the single strand pack.

17. A method of preparing a mold for casting a large concrete product formed in the mold at a mold location, the concrete product having a plurality of strands to prestress the concrete product, comprising the steps of:

placing a single strand pack of strand on a strand pack payout device at an assembly location;

placing a strand reel on a strand reel winder, the strand reel having a plurality of slots, each slot for receiving a length of strand;

rotating the strand reel on the strand reel winder with a hydraulic motor to rotate the strand reel about a vertical axis;

pulling out strand from the single strand pack and tensioning the strand between a retarding brake on the strand pack payout device and pulling wheels rotated by a hydraulic motor;

measuring the length of the strand passing through the pulling wheels;

securing the free end of said strand in said first slot of said plurality of slots in said strand reel;

winding said strand into the first one of said plurality of slots in the strand reel under tension;

cutting said strand after a predetermined length of the strand has passed through the pulling wheels to form a first segment of strand of predetermined length;

winding the cut end of said first segment of strand into said first one of said plurality of slots in the strand reel and securing said cut end of said first segment of strand in said first one of said plurality of slots with a securing device;

continuing to pull strand from said single strand pack while tensioning said strand, measuring the length of the strand until another predetermined length of strand has passed, cutting the strand to form a second segment of the strand of the predetermined length, winding said second segment of strand into a second one of said plurality of slots in the strand reel, winding the cut end of said second segment of strand into said second one of said plurality of slots and securing said cut end of said second segment of strand in said second one of said plurality of slots with a securing device; and removing the strand reel from the strand reel winder and transferring the strand reel to the mold location to eliminate the need for strand packs at the mold location to supply strand to the mold, the segments of strand providing uniform properties to the plurality of strands in the mold.

* * * * *